US010942014B2

(12) United States Patent
Stenzel et al.

(10) Patent No.: US 10,942,014 B2
(45) Date of Patent: Mar. 9, 2021

(54) PROJECTILE WITH EXPANDING MEDIUM

(71) Applicant: RHEINMETALL WAFFE MUNITION GMBH, Unterluess (DE)

(72) Inventors: Udo Stenzel, Bad Bocklet (DE); Tobias Litte, Hirrlingen (DE)

(73) Assignee: Rheinmetall Waffe Munition GmbH, Unterluess (DE)

( * ) Notice: Subject to any disclaimer, the term of this patent is extended or adjusted under 35 U.S.C. 154(b) by 0 days.

(21) Appl. No.: 16/699,351

(22) Filed: Nov. 29, 2019

(65) Prior Publication Data

US 2020/0263963 A1 Aug. 20, 2020

Related U.S. Application Data

(63) Continuation of application No. PCT/EP2018/063051, filed on May 18, 2018.

(30) Foreign Application Priority Data

Jun. 1, 2017 (DE) ..... 10 2017 112 128.5

(51) Int. Cl.
*F42B 12/06* (2006.01)
*F42B 12/34* (2006.01)

(52) U.S. Cl.
CPC ..... *F42B 12/06* (2013.01); *F42B 12/34* (2013.01)

(58) Field of Classification Search
CPC ..... F42B 12/06; F42B 12/34; F42B 12/367
USPC ..... 102/474, 475, 492, 496, 497, 507, 510
See application file for complete search history.

(56) References Cited

U.S. PATENT DOCUMENTS

| | | | | |
|---|---|---|---|---|
| 4,753,172 | A | 6/1988 | Katzmann et al. | |
| 5,127,332 | A | 7/1992 | Corzine et al. | |
| 5,325,787 | A * | 7/1994 | Boual | F42B 12/06 102/506 |
| 5,445,079 | A * | 8/1995 | Boual | F42B 12/06 102/506 |
| 6,186,072 | B1 * | 2/2001 | Hickerson, Jr. | F42B 12/06 102/517 |
| 6,659,013 | B1 * | 12/2003 | Kellner | F42B 12/06 102/516 |
| 7,520,224 | B2 * | 4/2009 | Taylor | F42B 12/06 102/473 |
| 2005/0235862 | A1 | 10/2005 | Gousman et al. | |
| 2019/0113320 | A1 * | 4/2019 | Folaron | F42B 12/06 |
| 2020/0166317 | A1 * | 5/2020 | Stenzel | F42B 12/367 |

FOREIGN PATENT DOCUMENTS

| | | | | |
|---|---|---|---|---|
| DE | 3802002 | A1 * | 8/1989 | F42B 12/06 |
| DE | 197 00 349 | C1 | 8/1998 | |
| DE | 29817414 | U1 | 1/1999 | |
| DE | 10 2011 011 478 | A1 | 8/2012 | |
| DE | 102008023678 | B4 | 11/2012 | |

(Continued)

*Primary Examiner* — Bret Hayes
(74) *Attorney, Agent, or Firm* — Muncy, Geissler, Olds & Lowe, P.C.

(57) ABSTRACT

A projectile that extends in the longitudinal direction and can be introduced into a cartridge by means of a casing. Moreover, the projectile has a projectile body that contains both a penetrator and an expanding medium. Characterizing the present invention, it is proposed to use metal foam, in particular air-foamed aluminum, as the expanding medium.

9 Claims, 1 Drawing Sheet

(56) References Cited

FOREIGN PATENT DOCUMENTS

| | | | |
|---|---|---|---|
| DE | 102012010141 | A1 | 11/2013 |
| EP | 0225532 | A1 | 6/1987 |
| GB | 1 605 020 | | 12/1981 |
| WO | WO9307438 | A1 | 4/1993 |
| WO | WO 2007/137697 | A1 | 12/2007 |

* cited by examiner

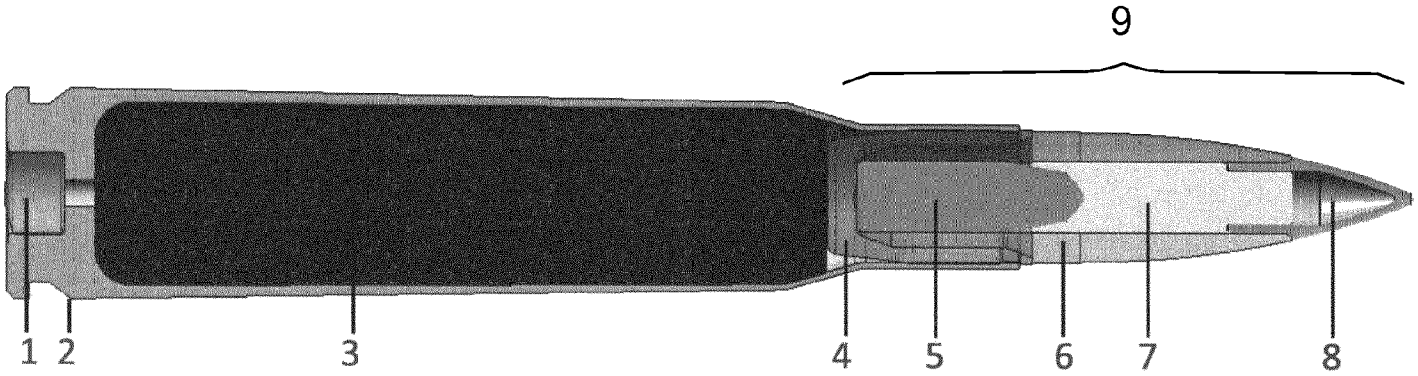
9
8
7
6
5
4
3
2
1

PROJECTILE WITH EXPANDING MEDIUM

This nonprovisional application is a continuation of International Application No. PCT/EP2018/063051, which was filed on May 18, 2018, and which claims priority to German Patent Application No. 10 2017 112 128.5, which was filed in Germany on Jun. 1, 2017, and which are both herein incorporated by reference.

BACKGROUND OF THE INVENTION

Field of the Invention

The present invention relates to a projectile for attacking lightly armored targets. Such a projectile serves to produce an effective body that, upon striking a hard target, is capable of breaking it up and having an effect in the interior of the target by forming fragments. For this purpose, the projectile should be designed such that it can act on the armor of the target in such a way that the actual penetrator of the projectile can pass through the armor, or at least the penetration thereof is made easier. This effect on the armor is accomplished by the kinetic energy of the penetrator contained in the projectile.

Description of the Background Art

To this end, DE 197 00 349 C1, which corresponds to U.S. Pat. No. 6,659,013, discloses a method of action of a projectile design for attacking armored targets. Disclosed therein are various expanding media whose task is to break up a projectile body when striking a hard target and to produce fragments, while a penetrator following thereafter pierces the armor of the target.

To achieve this goal, a projectile is proposed therein that has a projectile body made of a harder material than the expanding material in the interior of the projectile body. Upon striking a hard target, the expanding medium and projectile body are decelerated. The penetrator, which is supported behind the expanding material in the projectile body, compresses the expanding material as a result of its kinetic energy and breaks the projectile body apart into fragments. On account of its high kinetic energy, the penetrator continues on its way and pierces the armor. At least a portion of the fragments formed from the projectile body follows the penetrator through the bullet channel and has an effect within the target.

Various materials are proposed as expanding materials in the interior of the case, all of which have in common that the density of the expanding medium is lower than that of the case or of the penetrator.

The materials described in the aforementioned document as expanding medium are quite expensive, however, and are often associated with high costs to manufacture. The present invention is intended to overcome these disadvantages.

SUMMARY OF THE INVENTION

It is therefore an object of the present invention to provide a projectile for attacking armored targets that is inexpensive to manufacture and represents a lowest possible cost in manufacturing. It is likewise an object of the present invention to achieve high reliability of action.

In an exemplary embodiment, a projectile is provided that extends in a longitudinal direction. The projectile has a projectile base that at least partially accommodates a projectile body.

Provided within the projectile body can be a penetrator that is supported inside the projectile body such that it can move longitudinally.

In addition, a ballistic cap can be provided at the end of the projectile body that projects from the projectile base. This cap can be referred to as the front end. Located at the other end, the back end, can be the projectile base.

Provided at the back end of the projectile body is a jacket of deformable material that surrounds the projectile body, seals it at the rear, and undertakes the guidance of the projectile body in a weapon barrel. The front end of the projectile is formed by a ballistic cap.

The cap, which is attached to the front end of the projectile in the direction of flight, provides for good aerodynamics of the projectile and thus good flight characteristics.

The present invention is characterized in that metal foam is proposed as an expanding medium within the projectile body. Thus, the penetrator and the expanding medium are supported within the projectile body.

Foamed metals, in particular closed-cell air-foamed aluminum, have multiple advantages over the previously known materials as an expanding medium. Advantages to be noted in this regard are low density, good deformability, and inexpensive manufacture by foaming, forming, or cutting from sheet material.

Metal foam and the manufacture of this metal foam are already known, for example from the VDI publication "Aluminiumschäume and ihre Eigenschaften" [Aluminium foams and their properties] (ISBN 3-18-091324-X), which is incorporated herein by reference.

On impact of the projectile according to the invention with a target, the cap first breaks away from the projectile or shears off from it. The cap has no further effect in piercing armor, but instead is intended solely to improve the ballistic flight characteristics of the projectile.

The projectile thus strikes the target to be hit. The expanding medium located in the projectile body likewise strikes the target, and is compressed in the direction of the target by the abrupt deceleration of the projectile. This compression is intensified, furthermore, by the penetrator likewise located in the projectile body, since the penetrator has a higher density than the expanding medium.

The projectile body preferably penetrates the target at least in some areas, so that the projectile body forms, with the target, a closed unit that encloses the expanding medium.

Because the projectile body is made from a material with high density and provides no possibility for the expanding medium to escape from the projectile body when striking a target, the expanding medium is compressed in the direction of the target. The projectile body is broken apart by this compression.

The use of metal foam, such as, e.g., aluminum foam, as the expanding medium has the surprising advantage that the fluid that is bound in the pores of the metal foam is likewise compressed in the direction of the target to the point of plasma formation. The energy of such a compressed fluid assists the breakup of the projectile body in the process. High reliability of action is ensured by this plasma formation.

An expanding medium of aluminum foam thus has easy deformability with the motion of the penetrator when striking a hard target. At the same time, the enclosed fluid is compressed to the point of plasma formation and acts on the projectile body so that the body deforms and/or breaks apart. Preferably, air is proposed as the fluid.

Advantageously, a breakup of the projectile body is prevented when the projectile strikes a soft target. In this case, the expanding medium can be compressed insufficiently by the soft target, so no fragmentation effect takes place with a soft target.

To make it possible for the projectile according to the invention to function, the material of the projectile body has a higher density than the expanding medium. Likewise, the material of the penetrator has a higher density than the expanding medium. Lastly, the material of the projectile body has a higher density than the cap of the projectile.

The penetrator can be made of tungsten or a tungsten alloy, since tungsten offers a high strength and constitutes a proven material for penetrators. The use of a tungsten-containing substrate is likewise possible.

The projectile can be inserted in a cartridge. For this purpose, the projectile base of the projectile is at least partially accommodated in a casing. A suitable propellant charge can then be provided inside the casing. For igniting the propellant charge, a primer is arranged in the casing. Preferably, the primer is at least partially accommodated in the casing, and thus is partly accessible from outside the casing.

The propellant charge is in contact with the primer and thus can be ignited by the primer. Preferably, the propellant charge can be formed of propellant powder, for example ECL. The ignition of the propellant charge and its burning or decomposition generates a suitable propellant gas, which is discharged from the projectile through guides provided for the purpose, thus propelling the projectile.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWING

The present invention will become more fully understood from the detailed description given hereinbelow and the accompanying drawing which is given by way of illustration only, and thus, are not limitive of the present invention, and wherein: the sole FIGURE is a schematic cross-section through a cartridge with a projectile according to the invention.

DETAILED DESCRIPTION

The FIGURE shows a cartridge with a projectile 9 according to an exemplary embodiment of the invention, wherein the cartridge extends in the longitudinal direction and is shown as a cross-section.

The cartridge includes a projectile 9 and has a casing 2 and a primer 1 that is located at one end of the casing 2 of the projectile 9. The primer 1 is thus located at the back end of the casing 2 in the direction of flight. The primer 1 is located inside the casing 2 such that it is accessible from outside the casing 2 so that it can be ignited by an ignitor. For the purposes of the present invention, an ignitor can, for example, act mechanically on the primer 1.

The projectile 9 according to the invention has a projectile base 4 that at least partially accommodates a projectile body 6. In the cartridge form, the projectile base 4 is enclosed in the casing 2, namely at the opposite end of the projectile 9 when viewed from the primer, and thus in the direction of flight of the projectile.

Supported within the projectile body 6 are a penetrator 5 and an expanding medium 7. The expanding medium 7 in this case has a lower density than the penetrator 5 and the projectile body 6.

The projectile 9 likewise includes a cap 8 that is arranged at one end of the projectile body 6. In this arrangement, the cap 8 and the end of the casing 2 at which the primer 1 is attached form the two ends of the cartridge in the longitudinal direction.

A metal foam is provided as the expanding medium 7, because it has a low density, is inexpensive to manufacture, and has a simple manufacturing process.

The propellant charge 3 of the casing 2 can be formed of propellant powder, and is in contact with the primer 1. It is thus possible to ignite the propellant charge 3 by acting on the primer 1. The gas produced by the ignited propellant charge 3 can escape from the casing 2 through suitable discharge openings and propel the projectile.

The projectile 9 is propelled by the propellant charge 3, and thus accelerates the projectile body 6 held in the projectile base 4.

An aerodynamic flight is made possible for the projectile by the cap 8. The cap 8 is not necessary for the method of action upon striking the target, however, and is therefore designed such that the cap 8 breaks away or shears off upon impact.

The projectile 9 according to the invention thus strikes the target with the projectile body 6, and in the case of a hard target penetrates the target at least partially. As a result of the at least partial penetration of the projectile body 6 into the hard target or armor, the expanding medium 7 within the projectile body 6 is enclosed. The expanding medium 7 is likewise decelerated in the direction of the target, namely by the abrupt velocity change at the target as well as by the deceleration of the penetrator 5, which likewise pushes the expanding medium 7 in the direction of the target.

As a result of the easy deformability of the expanding medium 7, the penetrator 5 can likewise move in the direction of the target in this case, during the course of which it deforms and compresses the expanding medium 7. As a result of this compression, the expanding medium 7 continues to deform the projectile body 6 so that the latter is crushed and deforms or crushes the target, with the goal of piercing the armor of the target.

The fluid contained in the pores of the metal foam is likewise compressed to the point of plasma formation. As a result of this plasma formation the projectile body 6 is deformed still further to the point when the projectile body 6 breaks apart.

The present invention is not limited to the above-mentioned materials. Rather, additional embodiments are possible. Thus, it is possible that the expanding medium 7 itself forms the cap, and consequently the projectile dispenses with a separate part for the cap. Accordingly, the cap can be designed as a single part made of the expanding medium or as a separate component. Moreover, it is possible to use other light metals instead of aluminum for the metal foam.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A projectile that extends in a longitudinal direction, the projectile comprising:

a projectile base that at least partially accommodates a projectile body;

a penetrator that is supported inside the projectile body;

an expanding medium arranged within the projectile body, the expanding medium being a metal foam; and;

a cap that is arranged at an end of the projectile body.

2. The projectile according to claim 1, wherein the projectile base shields the projectile body with regard to a propellant charge.

3. The projectile according to claim 1, wherein a material of the projectile body has a higher density than the expanding medium.

4. The projectile according to claim 1, wherein a material of the penetrator has a higher density than the expanding medium.

5. The projectile according to claim 1, wherein a material of the projectile body has a higher density than the cap.

6. The projectile according to claim 1, wherein the expanding medium contains pores that are adapted to be filled with a compressible fluid.

7. The projectile according to claim 6, wherein the compressible fluid is compressed to the point of plasma formation.

8. The projectile according to claim 1, wherein the penetrator is made of tungsten or a tungsten alloy or a tungsten-containing substrate.

9. A cartridge comprising:

a projectile according to claim 1;

a casing that encloses the projectile; and a primer that is at least partially arranged in the housing.

* * * * *